US008134430B2

(12) United States Patent
Chen et al.

(10) Patent No.: US 8,134,430 B2
(45) Date of Patent: Mar. 13, 2012

(54) TRIGGER DEVICE USED IN A PALMTOP COMPUTER

(75) Inventors: Chun-Hsien Chen, Hsin-Tien (TW); Tzu-Chi Wei, Hsin-Tien (TW)

(73) Assignee: Unitech Electronics Co., Ltd., Taipei (TW)

( * ) Notice: Subject to any disclaimer, the term of this patent is extended or adjusted under 35 U.S.C. 154(b) by 1520 days.

(21) Appl. No.: 11/559,698

(22) Filed: Nov. 14, 2006

(65) Prior Publication Data

US 2008/0110737 A1 May 15, 2008

(51) Int. Cl.
*H01H 9/00* (2006.01)
*H01H 23/00* (2006.01)

(52) U.S. Cl. ..... 335/205; 335/206; 335/207; 200/401; 235/462.48; 235/472.01

(58) Field of Classification Search ..... 335/205–207; 200/310–317, 344–345, 401, 517; 235/462.48, 235/462.49, 472.01, 462.01, 440, 441, 484, 235/462.45, 462.43
See application file for complete search history.

(56) References Cited

U.S. PATENT DOCUMENTS 1,967,122 A * 7/1934 Horst ..... 335/23
2,535,384 A * 12/1950 Batt ..... 307/10.1
3,209,097 A * 9/1965 Shlesinger, Jr. ..... 335/207
3,273,091 A * 9/1966 Wales, Jr. ..... 335/207
4,489,297 A * 12/1984 Haydon et al. ..... 335/207
6,057,554 A * 5/2000 Plesko ..... 250/566
6,563,415 B2 * 5/2003 Armstrong ..... 338/47
6,984,797 B2 * 1/2006 Morita et al. ..... 200/314
7,306,156 B2 * 12/2007 Wulff et al. ..... 235/462.48
7,497,382 B2 * 3/2009 Mitelman et al. ..... 235/462.48
2003/0066520 A1 * 4/2003 Chang ..... 124/27

* cited by examiner

*Primary Examiner* — Mohamad Musleh
(74) *Attorney, Agent, or Firm* — Chun-Ming Shih; HDLS IPR Services

(57) ABSTRACT

A trigger device includes a retaining frame, a swing arm, a toggle switch, a resilient member and a touch component. An end of the swing arm is connected to the middle of the retaining frame, and another end of the swing arm is connected to a magnetic sensor, and an end of the toggle switch is pivotally connected to the top of the retaining frame. The swing arm forms a pressing rod disposed on the toggle switch and pressed for swinging the swing arm. The retaining frame and swing arm are connected to the resilient member, and the touch component is mounted into the retaining frame and installed at another end of the toggle switch. An elastic button is installed between the touch component and the toggle switch for pressing the toggle switch. Obvious feel and tough can be provided to enhance the operability and convenience of the trigger device.

10 Claims, 6 Drawing Sheets

TRIGGER DEVICE USED IN A PALMTOP COMPUTER

BACKGROUND OF THE INVENTION

1. Field of the Invention

The present invention relates to a trigger device, and more particularly to a trigger device used in a palmtop computer.

2. Description of Prior Art

To expedite distributions, logistics and warehouse businesses and process a large quantity of data in the shortest time, a bar code is the trend for products of our daily life. Not only supermarket, warehouse and distribution businesses use bar codes as a tool for controlling merchandises, but payments for parking tickets, credit cards and other bills also use bar codes as a necessary input tool. Further, a bar code cannot be read and determined visually and totally relies on a palmtop computer such as a scanner for its operation. Therefore, it is a main subject of the present invention to find a way of enhancing the operability and convenience.

In general, a traditional trigger device of a palmtop computer having a magnetic switch includes a retaining frame, a swing arm, a toggle switch and a resilient member, wherein an end of the swing arm is connected to a middle section of the retaining frame and another end of the swing arm is connected to a magnetic sensor, and an end of the toggle switch is pivotally connected to the top of the retaining frame, and a pressing rod is formed on the toggle switch for pressing the swing arm, and the resilient member is connected separately to the retaining frame and the swing arm, such that when the toggle switch is pressed, the sensor of the swing arm will be controlled to turn on or off the palmtop computer.

However, there are still some drawbacks existed in the practical applications of traditional trigger devices used in palmtop computers. Since a traditional device usually does not come with a touch component, users cannot observe a palmtop computer being turned on and reading data while the toggle switch is moved backward all the way to the end of its traveling path. As a result, users may press the toggle switch repeatedly to read data, or users may press the toggle switch too long that rapidly wastes a great deal of power consumption of the palmtop computer and greatly lowers its operability and convenience. The foregoing shortcomings of the prior art demand immediate attentions and require further improvements.

SUMMARY OF THE INVENTION

In view of the foregoing shortcomings of the prior art, the inventor of the present invention based on years of experience in the related industry to conduct experiments and modifications, and finally designed a trigger device for a palmtop computer in accordance with the present invention to overcome the shortcomings of the prior art.

The present invention is to overcome the shortcomings and avoid the existing deficiencies of the prior art by providing a trigger device for a palmtop computer, wherein a touch component is installed between a retaining frame and a toggle switch, such that when the toggle switch is pressed, obvious feel and touch of a click can be provided to greatly enhance the operability and convenience.

The invention provides a trigger device that comprises a retaining frame, a swing arm, a toggle switch, a resilient member and a touch component. An end of the swing arm is connected to the middle section of the retaining frame, and another end of the swing arm is connected to a magnetic sensor and an end of the toggle switch is pivotally connected to the top of the retaining frame, and a pressing rod is formed on the toggle switch for pressing the swing arm. The resilient member is connected separately to the retaining frame and the swing arm. The touch component is fixed in the retaining frame and installed at another end corresponding to the toggle switch, and an elastic button is installed between the touch component and the toggle switch for pressing the toggle switch.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings.

Figure 1:
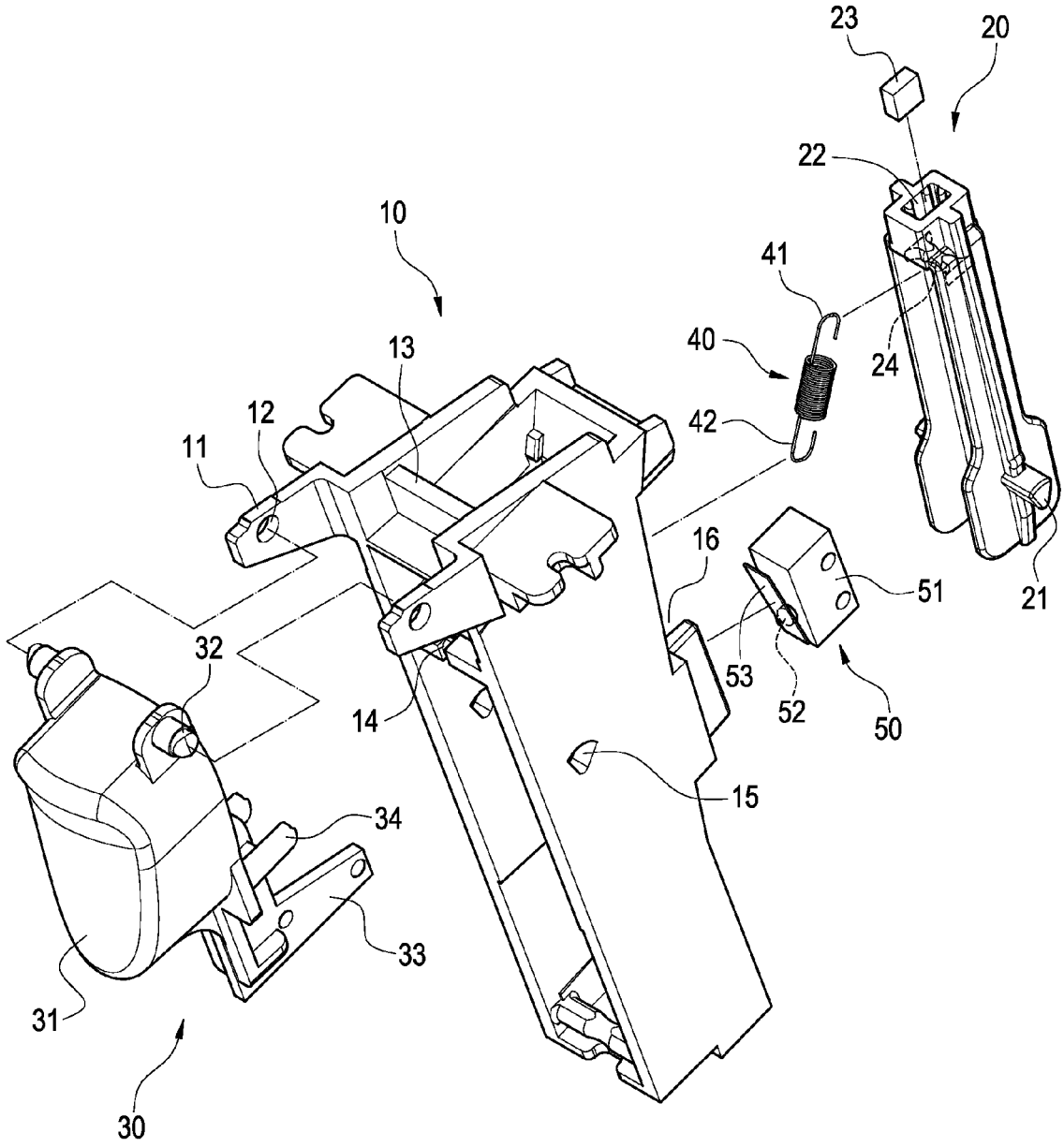
FIG. 1 is an exploded view of the present invention.
Figure 2:
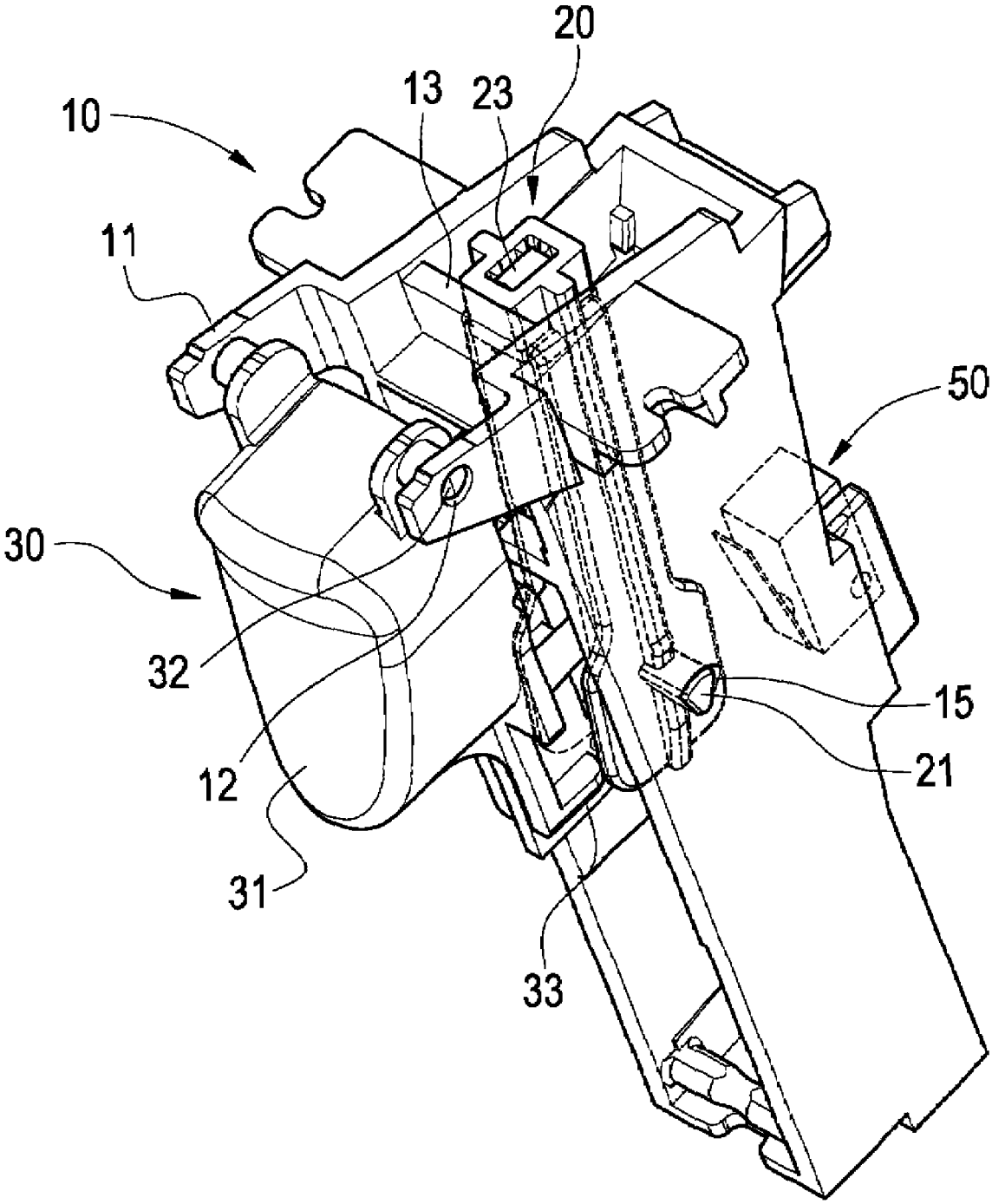
FIG. 2 is a schematic perspective view of the present invention.

Referring to FIGS. 1 and 2 for an exploded view and a schematic view of the present invention respectively, the invention provides a trigger device used in a palmtop computer, and the trigger device comprises a retaining frame 10, a swing arm 20, a toggle switch 30, a resilient member 40 and a touch component 50.

The retaining frame 10 is a rectangular frame being formed by a plurality of surrounding panels and comprising: two corresponding support arms 11 protruded outward from the top of the retaining frame 10; a through hole 12 connected to an end of each support arm 11; a transversal stop board 13 disposed at the middle of the rear of the two support arms 11 for limiting the swinging scope of the end of the swing arm 20; a transversal rod 14 disposed on both left and right sides of the bottom of the stop board 13; a fan-shaped hole 15 disposed at the middle section of the stop board 13 on the right side; and a containing groove 16 disposed on a board behind the fan-shaped hole 15.

The swing arm 20 is substantially in a n-shape, and comprises a fan-shaped member 21 protruded separately from the exterior of the bottom of both left and right sides and passed through the fan-shaped hole 15 of the retaining frame 1O. The swing arm 20 forms a rectangular groove 22 at the top of the swing arm 20, and the groove 22 is provided for installing and connecting a magnetic sensor 23, wherein the magnetic sensor 23 can be a permanent magnet, and the groove 22 forms a transversal rod body 24 under the groove 22.

The toggle switch 30 comprises a cap-shaped triggering portion 31, two corresponding protruding shafts 32 protruded from both left and right sides of the triggering portion 31 and pivotally connected to a through hole 12 of the retaining frame 10, a L-shaped pressing board 33 protruded backward from the bottom of the triggering portion 31, and two pressing rods 34 disposed at the lower edge of the triggering portion 31 and corresponding to both left and right side arms of the swing arm 20 for pressing and swinging the swing arm 20.

The resilient member 40 can be a tension spring having a hook 41 extended from both upper and lower ends of the resilient member 40, and the hooks 41, 42 are hooked onto the transversal rod 14 of the retaining frame 10 and the rod body 24 of the swing arm 20 respectively.

The touch component 50 can be a micro switch, but the micro switch is not electrically connected and it also conducts no transmission of electric signals. The touch component 50 comprises a base 51 and an elastic button 52 protruded from the front of the base 51, and the base 51 is mounted into the containing groove 16 of the retaining frame 10, and the elastic button 52 is installed corresponding to the pressing board 33 of the toggle switch 30, such that the touch and feel of a click can be produced during an operation. In addition, the touch component 50 of the invention further comprises a connected elastic plate 53 disposed at the bottom of the base 51 and extended obliquely outward, so that after the pressing board 33 of the toggle switch 30 is pressed onto the elastic plate 53, the elastic plate 53 will be pressed on the elastic button 52 to produce a feel of the click.

Figure 3:
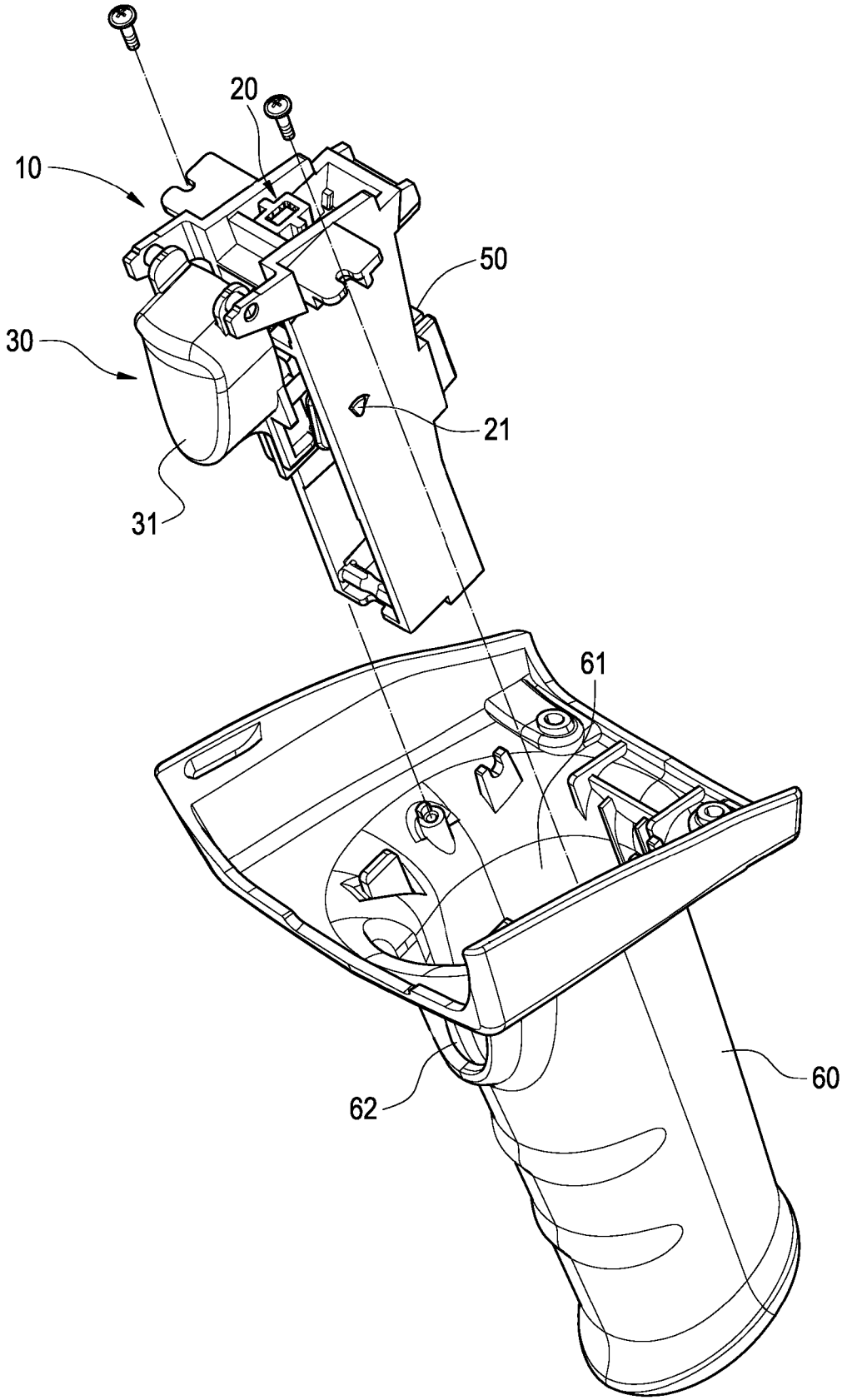
FIG. 3 is an exploded view of a trigger device and a handle of the present invention.
Figure 4:
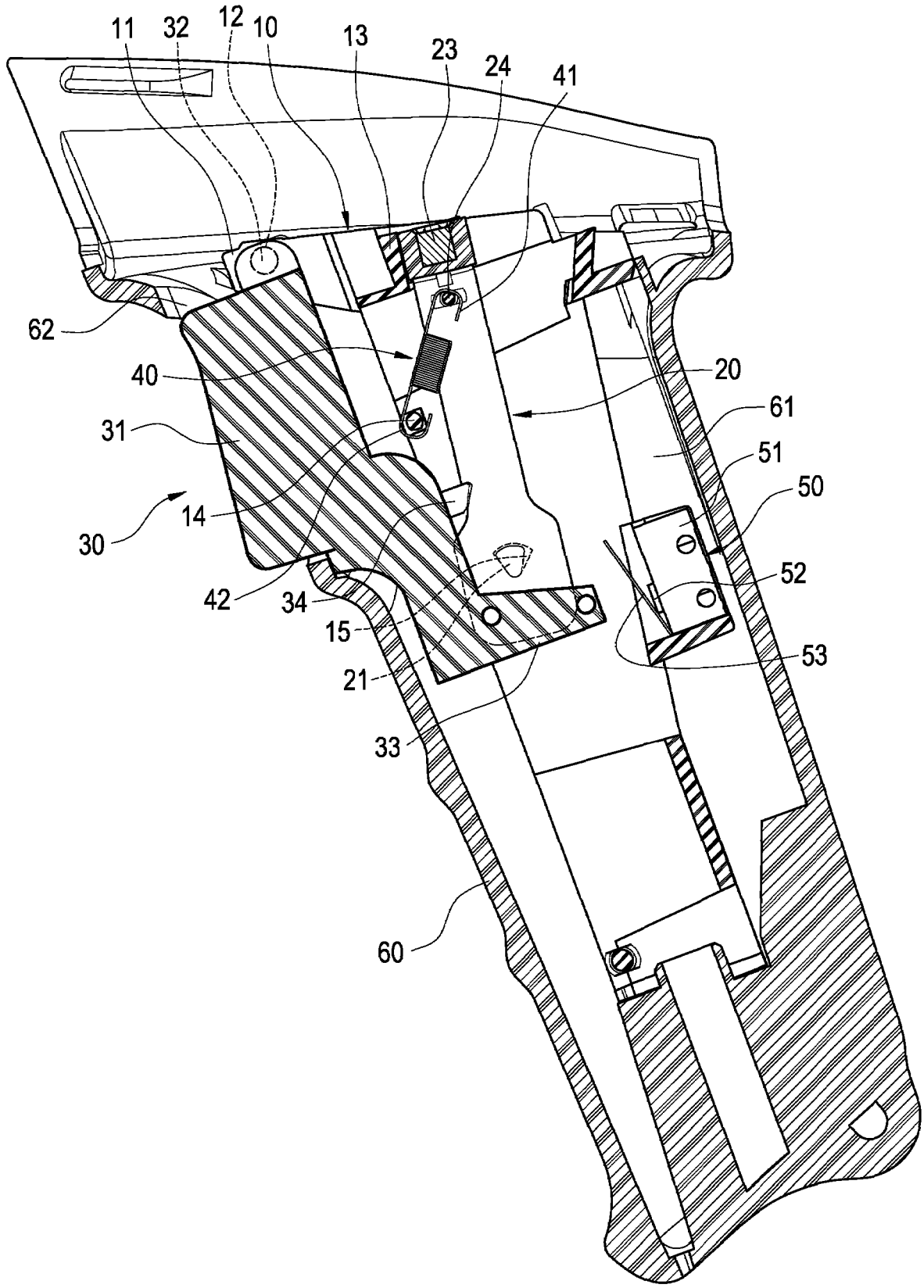
FIG. 4 is a cross-sectional view of a trigger device and a handle of the present invention.

Referring to FIGS. 3 and 4 for an exploded view and a cross-sectional view of a handle trigger device and a handle of the present invention respectively, the trigger device of the invention further comprises a T-shape handle 60, a hollow chamber 61 formed in the middle of the handle 60, and a through hole 62 formed at the front of a lateral side of the handle 60 and interconnected with the chamber 61. After the foregoing components are installed and placed into the chamber 61, the triggering portion 31 of the toggle switch 30 is precisely disposed at the corresponding position of the through hole 62 and exposed from the handle 60 and then mounted onto a horizontal board of the retaining frame 10 and screwed onto the handle 60, so as to constitute a trigger device of the present invention.

Figure 5:
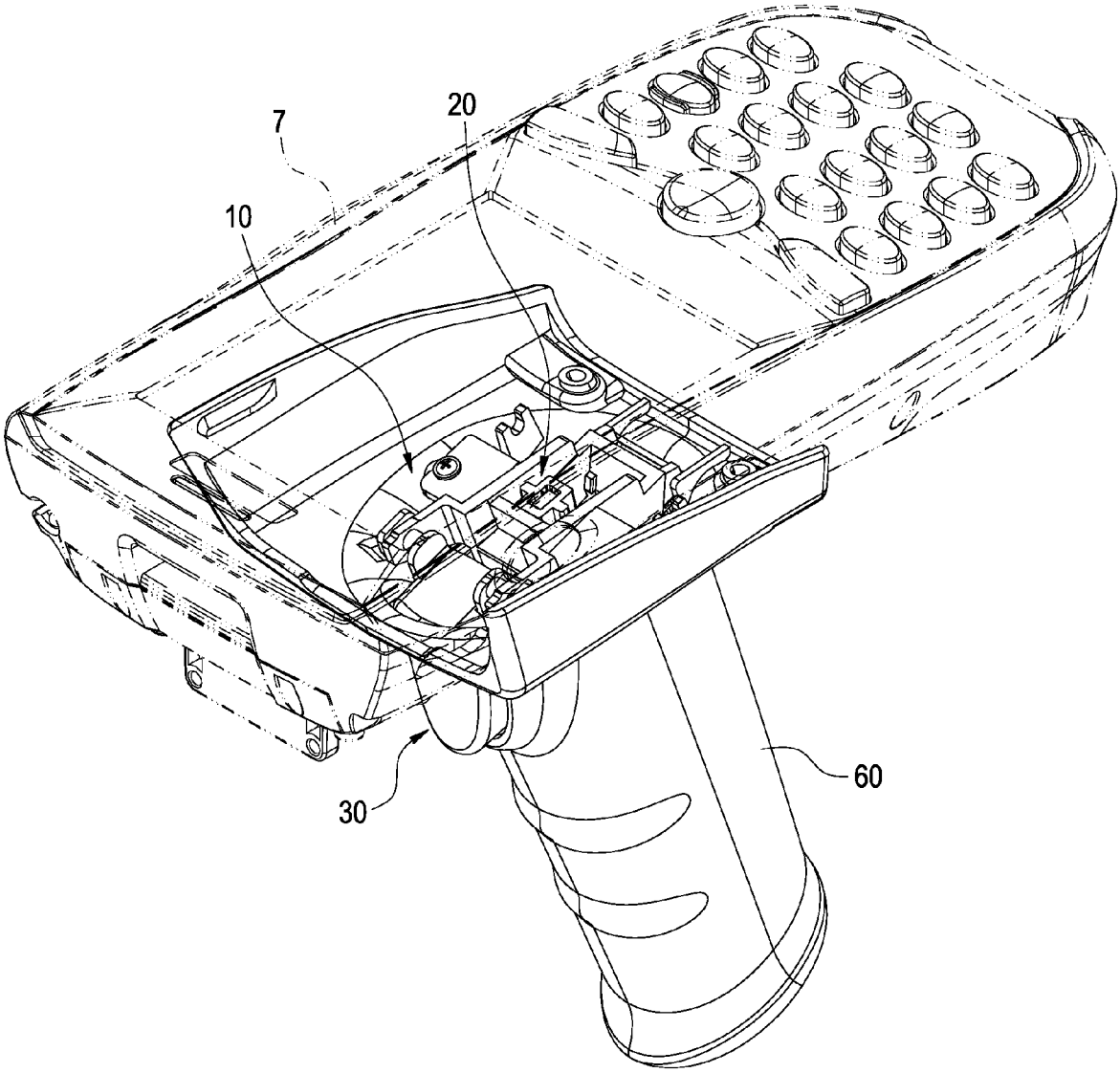
FIG. 5 is a schematic perspective view of a scanner applied to the present invention.
Figure 6:
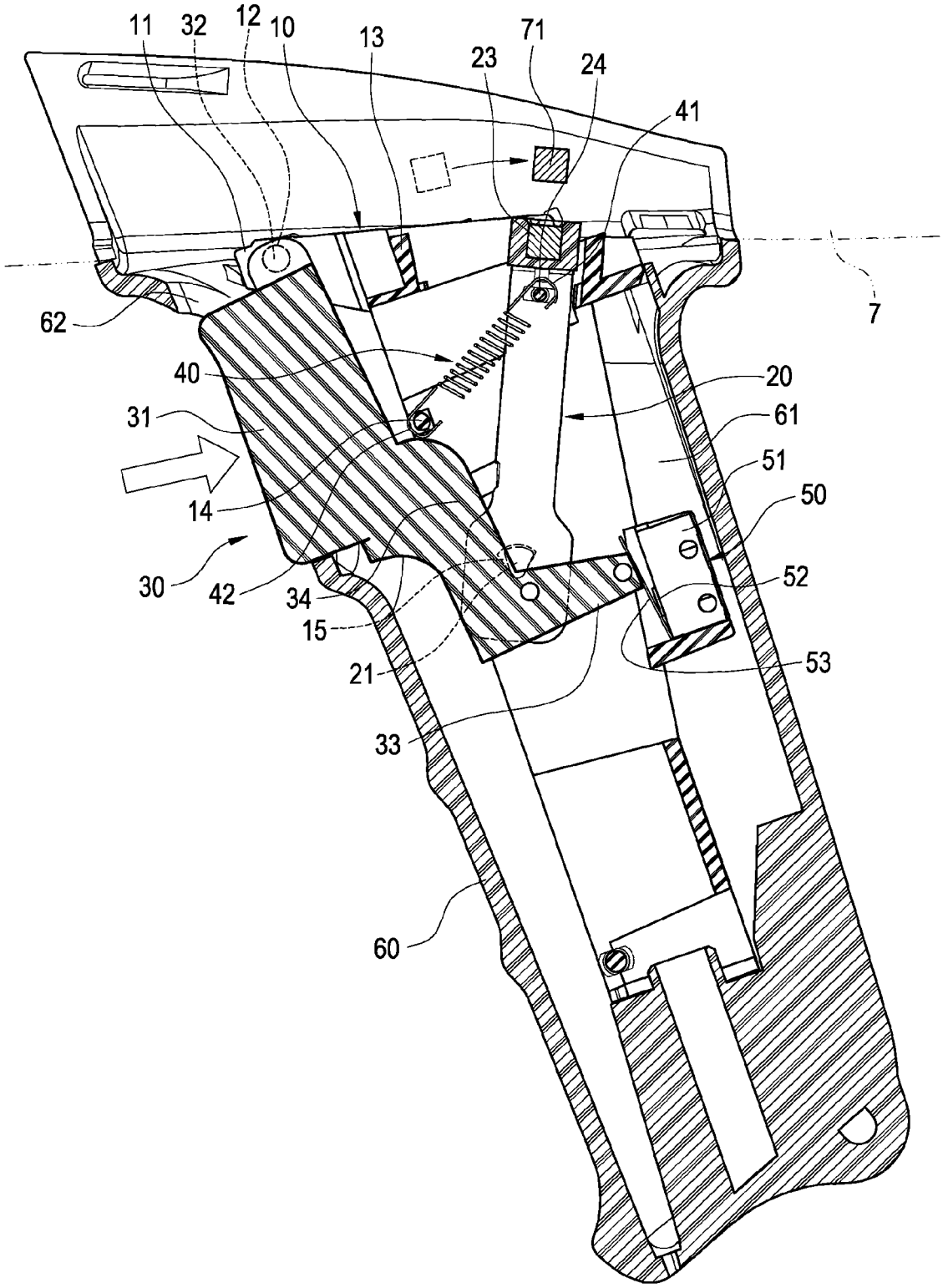
FIG. 6 is a cross-sectional view of an application as depicted in FIG. 5.

Referring to FIGS. 5 and 6 for a schematic view and a cross-sectional of a trigger device being used together with a scanner in accordance with the present invention respectively, the invention is provided for connecting a palmtop computer 7 such as a scanner, and the palmtop computer 7 installs a magnetic switch 71 at the position of a magnetic sensor 23 corresponding to the swing arm 20. Normally, the resilience of the resilient member 40 drives the trigger device to press the top of the swing arm 20 onto a stop board 13 of the retaining frame 10; such that if a user triggers the triggering portion 31 of the toggle switch 30, the pressing rod 34 of the toggle switch 30 is moved backward and pressed onto two lateral boards of the swing arm 20. While the swing arm 20 is swinging backward, the magnetic sensor 23 is moved backward as well, and the magnetic force of the sensor 23 is used for controlling the magnetic switch 71, such that the palmtop computer 7 can read data such as bar codes. Further, when the toggle switch 30 is moved to the end of its traveling path, the pressing board 33 is pressed on the elastic plate 53, and the elastic plate 53 is pressed on the elastic button 52; so that when the toggle switch 30 is triggered, obvious touch and feel of a click can be produced to greatly enhance the operability and convenience.

In summation of the description above, the trigger device used in a palmtop computer of the present invention complies with the patent application requirements, and thus is duly filed for patent application.

The present invention are illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A trigger device used in a palmtop computer, and the palmtop computer having a magnetic switch, and the trigger device comprising:

a retaining frame;

a swing arm, with an end coupled to a middle section of the retaining frame, and another end coupled to a magnetic sensor corresponding to the magnetic switch;

a toggle switch, with an end pivotally coupled to the top of the retaining frame, and forming a pressing rod disposed at the middle section of the toggle switch and pressed on the swing arm;

a resilient member, with both ends coupled respectively to the retaining frame and the swing arm; and a touch component, mounted on the retaining frame and installed corresponding to another end of the toggle switch, and an elastic button is disposed between the touch component and the toggle switch and pressed by the toggle switch.

2. The trigger device used in a palmtop computer of claim 1, wherein the retaining frame includes two corresponding support arms disposed at the top of the retaining frame, and a through hole disposed on each support arm; and the toggle switch includes a triggering portion, a protruding shaft disposed at the top of the triggering portion and corresponding to the through holes for a pivotal connection.

3. The trigger device used in a palmtop computer of claim 2, wherein the retaining frame includes a transversal rod formed under the support arm, and the swing arm has a rod body formed at an end with the magnetic sensor, and both ends of the resilient member are hooked to the transversal rod and the rod body.

4. The trigger device used in a palmtop computer of claim 1, wherein the retaining frame includes a fan-shaped hole disposed at the middle section of the retaining frame, and the swing arm includes a fan-shaped member protruded from the swing arm and corresponding to the fan-shaped hole for a connection.

5. The trigger device used in a palmtop computer of claim 4, wherein the retaining frame forms a containing groove at the rear of the fan-shaped hole, and the containing groove is provided for installing and connecting a touch component.

6. The trigger device used in a palmtop computer of claim 1, wherein the magnetic sensor is a permanent magnet.

7. The trigger device used in a palmtop computer of claim 1, wherein the toggle switch has a triggering portion and a pressing board protruded from the bottom of the triggering portion for pressing the elastic button.

8. The trigger device used in a palmtop computer of claim 1, wherein the resilient member is a tension spring.

9. The trigger device used in a palmtop computer of claim 1, wherein the touch component further includes a base and an elastic plate, and the elastic button is protruded from an end of the base, and the elastic plate is connected to the bottom of the base and extended obliquely to the outside.

10. The trigger device used in a palmtop computer of claim 1, further comprising a handle, a chamber formed in the handle, and a through hole interconnected with the chamber, and the retaining frame, the swing arm, the resilient member and the touch component are contained in the chamber, and the toggle switch corresponds to the through hole with a portion protruded from the exterior of the handle.

* * * * *